United States Patent [19]

Ruxton et al.

[11] Patent Number: 4,862,120

[45] Date of Patent: Aug. 29, 1989

[54] WIDEBAND STRIPLINE TO MICROSTRIP TRANSITION

[75] Inventors: James Ruxton, Ottawa, Canada; John Catranis, Clinton, N.Y.

[73] Assignee: Canadian Patents and Development Limited/Société Canadienne des Brevets et d'Exploitation Limiteé, Ottawa, Canada

[21] Appl. No.: 162,195

[22] Filed: Feb. 29, 1988

[51] Int. Cl.[4] ..... H01P 5/08

[52] U.S. Cl. ..... 333/34; 333/238

[58] Field of Search ..... 333/21 R, 33, 34, 238, 333/246

[56] References Cited

U.S. PATENT DOCUMENTS 4,626,805 12/1986 Jones ..... 333/33

4,733,202 3/1988 Forterre et al. ..... 333/33 X

*Primary Examiner*—Paul Gensler

*Attorney, Agent, or Firm*—Larson & Taylor

[57] ABSTRACT

The invention relates to a transition between a "stripline" and a "microstrip" transmission line which uses printed circuit board materials and processes. The transition, which includes a stripline region and a microstrip region, also includes a transitional region in which a quasi coaxial line section is provided in the stripline region near the termination of the upper ground plane. A double tapered double slot line is used to avoid discontinuity. The two slots taper to minimum width at the termination of the upper ground plane, and widen in the transition to the microstrip region. The transition is of wideband operation (e.g. from near DC to 20 gHz) and of high performance.

10 Claims, 2 Drawing Sheets

STRIPLINE

QUASI – COAX

TRANSITIONAL MODE

DOUBLE SLOT

COPLANAR WAVEGUIDE

MICROSTRIP

WIDEBAND STRIPLINE TO MICROSTRIP TRANSITION

BACKGROUND OF THE INVENTION

1. Field of the Invention

The invention relates to transmission lines and to transitions between different kinds of transmission lines. More particularly, the invention relates to a transition between a "stripline" and a "microstrip" transmission line.

2. Prior Art

Increasing use of high frequency circuitry in electronic equipment has led to simpler and more readily manufactured forms of r.f. propagating elements. Laboriously manufactured waveguides and coaxial lines have given way wherever possible, to lower cost and more easily manufactured stripline and microstrip transmission lines.

Stripline and microstrip transmission lines may be formed using printed circuit board (PCB) materials and processing. The starting material for typical stripline and microstrip transmission lines is a low loss, usually low dielectric constant material with good mechanical properties in sheet form coated on one or both sides with a continuous conductive layer. The conductive layer is selectively removed to achieve desired r.f. propagation paths by a highly automated printing process.

In wave propagating circuitry, two distinctive needs have arisen for "active" circuitry on the one hand and "passive" r.f. combining or distribution circuitry on the other hand. The solution to these needs has led to the large scale use of the two printed transmission lines mentioned above.

The "active" circuitry, which may include passive circuit components such as inductors, capacitors, resistors, discrete semiconductors, and monolithically integrated microwave integrated circuits, often requiring interconnections in a hybrid format, is usually best connected by "microstrip". A microstrip employs a single finite width conductor disposed on a layer of dielectric material over an "infinite" width conductor acting as a ground plane to propagate the r.f. signal. The microstrip configuration allows circuit components of variable thicknesses and requiring interconnection to be disposed on the top surface of the dielectric layer without the interference of an overlaying ground plane.

On the other hand "passive" r.f. combining or Distribution circuitry, for instance that used in beam forming for an antenna array, has a different requirement. This circuitry requires shielded transmission paths and complex branching. In "stripline", a single finite width conductor is disposed between two dielectric layers each having an outer ground plane. Appropriate dimensioning within the stripline assembly provides adequate internal isolation between distinct signal paths, while the outer ground planes provide external shielding comparable to that of a coaxial line or waveguide. The stripline is flexible in its applications and may be used to form delay lines, branching networks, circulators and other complex microwave interconnections.

The prevalence of both types of printed transmission lines in modern electronic equipment, and the usually complementary applications of the two type of lines has developed the need for both types of lines in the same electronic equipment and has created a need for a simple, easily manufactured transition from one form of transmission line to the other.

SUMMARY OF INVENTION

Accordingly it is an object of the invention to provide an improved transition between stripline and microstrip transmission lines.

It is another object of the invention to provide a transition between stripline and microstrip transmission lines which is simple in design.

It is still another object of the invention to provide a transition between stripline and microstrip transmission lines which is readily manufactured using printed circuit materials and processes.

It is a further object of the invention to provide a transition between stripline and microstrip transmission lines which is of broadband application and high performance.

These and other objects of the invention are achieved in a wide band stripline to microstrip transition comprising a stripline region, a microstrip region and a transitional region. The stripline region comprises an ungrounded central conductor of finite width disposed between an upper and a lower ground plane to support a vertical field above and a vertical field below the central conductor. The microstrip region comprises a central conductor and a lower ground plane which support a vertical field below said central conductor and which are conductive extensions of the corresponding members in the stripline region.

The transitional region has a first pair of conductors connected between the ground planes and flanking the central conductor adjacent the stripline region to form a grounded closed conductive path encircling the central conductor and supporting the transfer of the vertical fields of the stripline region to fields radially distributed about the central conductor similarly to the field distribution in a coaxial line.

The transitional region also has a second pair of conductors flanking the central conductor and coplanar therewith and grounded to the closed conductive path, thus forming a double slot transmission line. The two slots are of varying width, narrowing to a minimum value at a midpoint of the transition to transfer substantially all of the radial fields to the two horizontal fields supported in the double slots. Subsequently the slots widen to transfer the two horizontal fields to a vertical field supported in the region beneath the central conductor and lower ground plane characteristic of a microstrip transmission line. Further in accordance with the invention, the upper ground plane terminates near the point where the double slots are of minimum width for minimum discontinuity.

The transition is constructed having the upper ground plane supported on an upper dielectric layer over the central conductor, and the lower ground plane supported on a lower dielectric layer under the central conductor. The first pair of flanking conductors comprise two conductive members disposed in proximity to the opposite sides of the central conductor, with each member extending through the two dielectric layers and being electrically connected to adjacent portions of both the upper and the lower ground planes. These conductive members may preferably be fabricated as plated-through holes, and together with the ground planes they form a closed conductive path functioning as a short quasi-coaxial line section adjacent the stripline region. The second pair of flanking conductors and the central conductor are co-planar and are formed between the adjacent surfaces of the upper and lower dielectric layers. These conductors preferably are formed by subtractive patterning of an initially continuous conductive layer on one of the dielectric layer surfaces. Each of the second pair of flanking conductors is grounded as by connection to one of the first pair of conductors, to enable the function of this section of the transition as a double slot transmission line coupling the quasi-coaxial section to the microstrip region.

BRIEF DESCRIPTION OF THE DRAWINGS

The inventive and distinctive features of the invention are set forth in the claims of the present application. The invention itself, however, together with further objects and advantages thereof may best be understood by reference to the following description and accompanying drawings, in which:

DESCRIPTION OF THE PREFERRED EMBODIMENT

Figure 1:
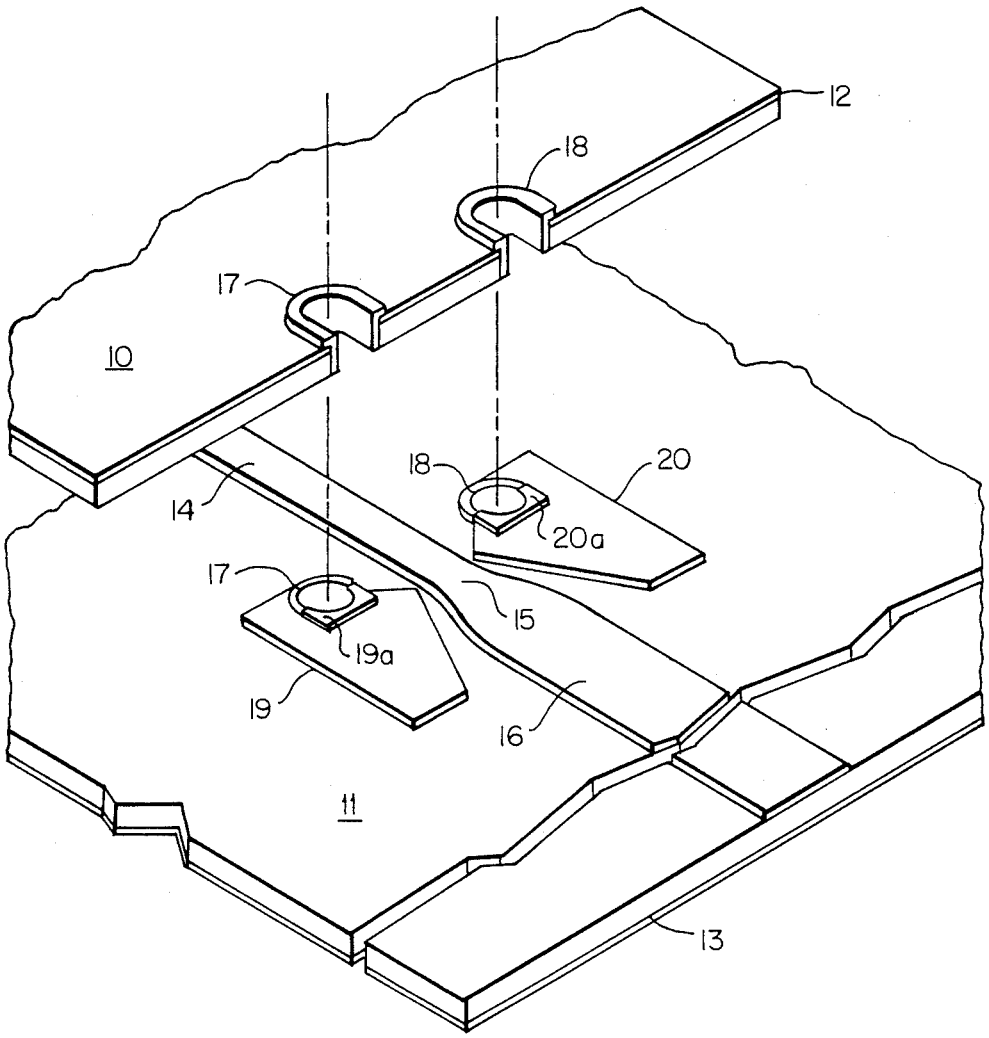
FIG. 1 is an illustration in perspective of a novel Stripline to microstrip transition.

Referring now to FIG. 1, a wideband stripline to microstrip transition in accordance with the invention is shown. The transition has a bandwidth extending from approximately DC to 20 ghz, with a low loss, and low reflectance through this range. The transition is fabricated on conventional substrate material requiring no external components and requiring a minimum of space.

The inventive transition is designed to solve the interconnection problem between stripline and microstrip, as for example in circuit assemblies in which the active circuitry is in microstrip and the passive circuitry is in stripline. Thus, the FIG. 1 arrangement, while having a rectangular outline depicting a single transition, will normally find its place in a larger circuit assembly and be replicated in large numbers when multiple signal paths require multiple stripline-to-microstrip transitions.

The novel transition is formed using two conventional laminate members 10 and 11 of unequal length assembled together to form a stripline region where both members overlap (to the left in FIG. 1) and a microstrip region where the longer, lower member 11 is unlapped (to the right in FIG. 1). The upper member 10 may be a commercially available microwave laminate having a solid copper ground plane on the upper surface (12) or a laminate having a copper layer on both surfaces with the under surface layer being removed at the time of assembly.

The lower laminate member 11 has metallization on both surfaces. The original continuous copper layer on the upper surface of 11 is selectively etched or otherwise patterned to provide the "finite" width central conductors 14–16 used in both the stripline and in the microstrip regions of the transition, while the ground plane 13 on the under surface is unbroken. As shown, the lower laminate member and the central conductors continue to the left into the stripline domain and to the right into the microstrip domain of the circuitry.

Returning now to the details of the transition, the ground plane 12 bonded to the upper surface of the upper dielectric layer 10, and the ground plane 13 bonded to the under surface of the lower dielectric layer 11 become the two ground planes of the stripline region. The central conductor (14,15,16) disposed between the dielectric layers 10 and 11 completes the stripline region of the transition.

The finite central conductor (14,15,16) is shown extending from the stripline region where it has a fixed finite width to the microstrip region where it also has a fixed finite width. The stripline portion 14 of the central conductor has a smaller width than the microstrip portion 16, the dimensions being selected to achieve a 50 ohm characteristic impedance in each region. In addition, in the vicinity of the inner edge of the upper laminate 10, conveniently defined to be the "midpoint" of the transitional region, the transitional portion 15 of the central conductor gradually and continuously increases in width from the stripline portion 14 to the microstrip portion 16.

For purposes of better understanding the invention, one might observe that while there is dc electrical continuity between the three regions, and while one might expect some portion of any r.f. energy introduced into one port to be transferred to a load connected to the other port, there is, without the improvements yet to be described, a very substantial discontinuity in the propagation of r.f. energy at the midpoint of the transition.

One may visualize the reflection occasioned to the energy entering from a source connected to the Stripline region and leaving via the microstrip region. The discontinuity between a stripline connected directly to a microstrip may be expected to reflect half of the energy back to the source. This arises from the fact that, without more, the microstrip region, into which the energy propagates, makes provision for only the half of the stripline fields which propagate below the central conductor, and no provision for the half of the stripline fields which propagate above the central conductor. One would expect half of the energy to be reflected back to the source in the unimproved transition.

The novel transition, now to be described in detail, avoids such reflections, and as will be seen, smoothly redistributes the fields as one progresses from the stripline region to the microstrip region.

The special means employed in the transition consist of a pair of vertical conductors 17, 18 flanking the conductor 15 near the midpoint of the transition, a pair of horizontal conductors 19,20 also flanking the conductor portion 15 near the midpoint of the transition, and an end surface configuration of the upper laminate and its metallization.

The vertical conductors (17, 18) preferably are formed as plated-through holes in the laminate members. The holes may be drilled or otherwise made, and extend completely through the laminates so as to permit electrical contact with the ground planes 12 and 13. The hole walls are then plated with a deposited metal which electrically connects the upper and lower ground planes together. The serial connection of the two vertical conductors with the two ground planes forms a continuous grounded surface around the central conductor 15 at one section (i.e. the section devated B—B) (or 2B—2B) in FIG. 3 and illustrated in FIG. 2B in the transitional region.

The grounded surface, encircling the central conductor, then permits the E field previously confined to regions above and below the conductor to rearrange itself in a more even radial distribution, with more lines of force having a lateral orientation extending toward the vertical conductors on either side. Since there is "conservation" of the field as one proceeds along the transition, assuming reflection-free transmission, an increase in lateral lines of force produces an equal decrease in vertical lines of force, and the total number remains the same.

Figure 2A:
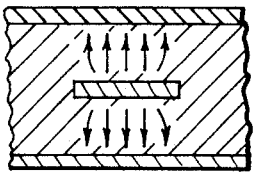
FIGS. 2A, 2B, 2C, 2D, 2E and 2F are six successive section views taken along the transmission path through the transition, the respective views illustrating the disposition of the conductive members and the fields which these members support.
Figure 2B:
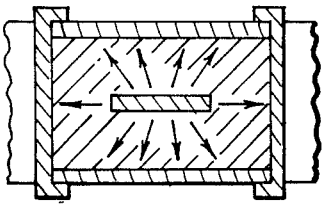

The field redistribution produced by the two grounded vertical conductors 17, 18 is, as noted above, illustrated in FIG. 2B. The field redistribution does not all take place at one coordinate but rather takes place gradually commencing near the left edge of the conductors 17 and 18, and increasing until one reaches a line drawn through their centers. Through the region affected by the proximity of the vertical conductors to the central conductor, the E fields are distributed radially for a full 360° about the central conductor 14 leading to the two ground planes and two vertical conductors. In this region, the transmission mode may be said to be coaxial in nature. FIG. 2B illustrates the field condition at the B—B (or 2B—2B) cross-section.

The quasi-coaxial mode transitions to a double slot mode to the right of the line of centers of the vertical conductors as the two grounded horizontal conducting members 19,20 flanking the central conductor 15 begin to redistribute the field into the two slots in continuation of the transition to the microstrip region.

The construction of the members 19 and 20 is illustrated in FIG. 1, which is an exploded view. The members 19 and 20 are perforated, and in the assembled condition are connected to the ground planes 12 and 13 by the conductive plating used to form the vertical conductors 17 and 18. It will be noted that the holes through which the upper portions of vertical conductors 17,18 extend are centered a small distance from the end surface or termination of the upper laminate 10. If these holes were left of circular section, as a possible alternative, they would not be open through the end surface of laminate 10 but would be separated from it by a thin intervening wall of dielectric material. However, the connection of the vertical plating to the horizontal conductors 19 and 20 is enhanced by removal of this intervening material, thus exposing the upper surfaces of the horizontal conductors 19,20 immediately adjacent to the plated-through holes. This allows the through-hole plating to bond to the top surfaces of the horizontal conductors. The resulting non-circularity of the holes and their plating in the upper laminate does not affect the r.f. fields in the transition, because the r.f. fields here are concentrated in the narrowed slots defined by the horizontal conductors 19 and 20, leaving the more remotely disposed plated surfaces in a relatively field-free region. As illustrated in FIG. 1, raised arch-shaped portions **19*a* and 20*a* of horizontal conductors 19 and 20 encircle roughly one half of the tops of the holes defined by lower portions of vertical conductors 17 and 18 and mate with the corresponding free ends of the upper portions of vertical conductors 17 and 18**.

Figure 3:
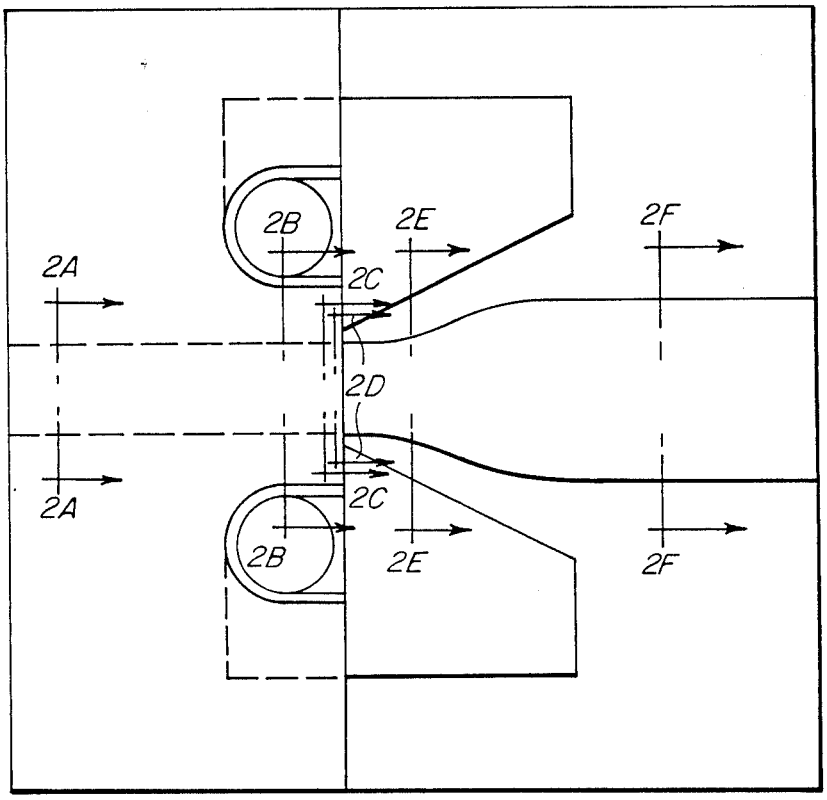
FIG. 3 is a plan view of the transition illustrating more exactly the disposition of the critical conductive members in the transition and the planes of the successive sectional views.

As illustrated in FIG. 3, the members 19 and 20 extend to the right along the transmission path from the left edge of the vertical conductors 17 and 18 to the midpoint of the transition region (the midpoint being defined by the right edge of the upper laminate) and continue to the right, to the point or just beyond the point where the central conductor has attained the full microstrip width.

The inner edges of the flanking horizontal members 19,20 and the outer edges of the central member create two horizontal slots, which due to the grounded condition of members 19 and 20, allows the E field to concentrate between these edges as a function of their mutual proximity. The flanking horizontal members 19 and 20 converge inwardly on the central conductor from the Section B—B to the midpoint of the transitional region at section D—D and diverge from the midpoint toward the microstrip region until they terminate short of the section F—F. At the midpoint, the slots are of minimum width, and effect the greatest horizontal concentration of the E field.

Figure 2C:
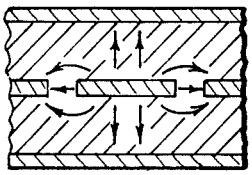

Convergence of the horizontal flanking members 19 and 20 upon the central conductor (14) from section B—B to the midpoint (section D—D) produces a gradual increase in the horizontal components of the field. At the section B—B, the horizontal members have negligible effect on the fields since the vertical conductors are equally close to the central conductor. At the section C—C, the slot is now narrowed as the horizontal members become closer to the central conductor than the vertical conductors. At section C—C the E field as shown in FIG. 2C, exhibits an increased horizontal component.

Figure 2D:
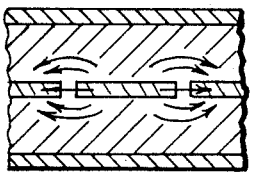

The trend to concentration of the field in a horizontal plane continues to the midpoint of the transition where the slots reach a minimum dimension. This occurs at section D—D and the field is illustrated at FIG. 2D. The mode at section D—D may be termed a double slot mode, implying sufficient field concentration in the slots to allow the upper ground plane (10, 12) to be terminated without creating a discontinuity in propagation. This is true because most of the lines of force now run horizontally, confined to the slots, thus depleting the vertical fields to the upper or lower ground planes. As a result, the removal of the upper ground plane results in substantially no loss in the total field, substantially no change in impedance and no creation of reflections.

Figure 2E:
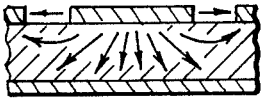
Figure 2F:
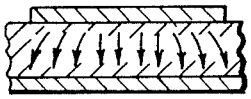

The slots begin to widen past the midpoint minimum at section D—D and, as this occurs, the vertical fields to the lower ground plane now increase leading to the transfer of all the field to the region under the central conductor as in a normal stripline. The field at section E—E, as illustrated at FIG. 2E, represents a partial conversion. At section E—E, the mode of propagation is that of a coplanar waveguide. As the slots widen past section E—E, the horizontal fields in the slots continue to diminish. Once past the transition region, as for instance at the section F—F, the horizontal fields in the slots are extinguished, transferring all of the field to the region between the central conductor (16) and the bottom ground plane where a vertical field is formed as illustrated in FIG. 2F. The field distribution at this point on is that of a microstrip transmission line.

The taper of the slots is also designed to maintain the impedance substantially constant throughout the transition.

Summarizing, the successive field distributions consist initially of the stripline mode (FIG. 2A) with vertical fields above and below the central conductors, the quasi coax mode (FIG. 2B), the transitional mode (FIG. 2C), leading to the double slot line mode (FIG. 2D) with horizontal fields to either side of the central conductor. Next with the termination of the upper ground plane, the horizontal fields are converted via the coplanar waveguide mode of FIG. 2E, to the vertical field, immediately below the central conductor. Next with the termination of the upper ground plane, the horizontal fields are converted via the copolanar waveguide mode of FIG. 2E, to the vertical field, immediately below the central conductor.

The foregoing field redistributions can be made sufficiently smoothly to retain a very nearly constant input impedance. In the embodiment illustrated for 6 to 18 gHz operation, the return loss at the input (S11) exceeds 17 db; the loss forward (S21) is less than 0.2 db, the loss in reverse (S12) is less than 0.2 db, and the return loss at the output (S22) exceeds 17 db. These figures imply equal performance in either the stripline to microstrip signal direction or in the microstrip to stripline signal direction.

The dimensions of the exemplary line operating in the 6–18 gHz range are small. The hole dimensions for the vertical 1 conductors are 0.020″ in diameter, and the thickness of the substrate dielectric material, typically "Duroid" is 0.010″. The conductive layers are 0.001″, and the width of the central conductor in the stripline region is 0.0166″ and in the microstrip region 0.037″. The slots narrow to 0.0013″ at the section D—D, and increase to 0.015″ at the edges of the members 19 and 20 toward the microstrip. At the edges of the members 19 and 20 toward the stripline, the slot distance is 0.020″. The distance from the vertical members to the central conductor is 0.020″. The construction permits a 50 ohm to 50 ohm characteristic impedance.

The construction is of substantial simplicity not requiring intermediate transition materials. The vertical conducting members 17, 18 in the transition may be plated-through holes as earlier described, or they may be holes filled with a conductive epoxy or metal post members electrically connected to the ground planes and to the horizontal conducting members 19,20. The inner wall dimensions of the vertical conductors forming the quasi-coaxial region and the configuration of the horizontal conductors forming the slots may also be modified. However, the illustrated contours represent an efficient computer optimization, and provide a very simply built and practical disposition. More particularly the central conductor is of constant width throughout the stripline section, is softly curved into the expansion required as one enters the microstrip mode and is of constant width thereafter in the microstrip region. The five sided horizontal conductors have straight inner edges and as earlier noted, the vertical members are cylindrical and easily drilled.

In a configuration for operation at a different impedance or differing frequency, the dimensions will of course be different. The transitions, also may be modified to reflect either tighter or more relaxed tolerances.

While the transmission mode in FIG. 2B is designed as quasi-coax, for convenience the electric field configuration can be modelled as for a suspended substrate line.

The terms "vertical" and "horizontal" hereinabove applied to the elements of the transition are intended to describe the position of the elements in relation to the planes of the layers disposed in the stripline, microstrip, and transitional regions, and not necessarily in relation to earth-referenced planes. The assembly uses laminar layers, conventional for printed circuit processing, all of which lie in parallel planes. Accordingly, "vertical" has been intended to mean perpendicular to these planes, and "horizontal" has been intended to mean parallel to these planes.

What is claimed is:

1. A wideband stripline to microstrip transition providing a continuous transmission path consisting of a stripline region, a microstrip region and an intermediate transitional region, said transition comprising (1) first and second juxtaposed dielectric layers each having a ground plane contiguous with the outwardly facing surface thereof, said first dielectric layer being coextensive with said stripline region and terminating at a midpoint in said transitional region, and said second dielectric layer being coextensive with said stripline, microstrip and transitional regions, (2) a patterned conductive layer between and contiguous with the inwardly facing surfaces of said first and second dielectric layers and including (a) an ungrounded central conductor defining said transmission path and supporting wave propagation between said central conductor and both said ground planes in the stripline region and between said central conductor and the ground plane on said first dielectric layer in the microstrip region, and (b) a first pair of conductor members electrically connected to said ground planes and disposed in co-planar flanking relation with said central conductor to define therewith a double slot transmission path in said transitional region adjoining the microstrip region, and (3) a second pair of conductor members extending through said first and second dielectric layers in flanking relation with said central conductor and electrically connected to each of said ground planes to form a grounded surface encircling said central conductor and defining therewith a quasi-coaxial transmission path between and adjoining the stripline region and said double slot transmission path in said transitional region.

2. The transition set forth in claim 1 wherein: said first conductor members extend through said transitional region and converge inwardly from said stripline region in the vicinity of said second conductor members to progressively narrow the slots of said double slot transmission path to minimum width near said transitional region midpoint, and flare outwardly from said midpoint toward said microstrip region to progressively widen said slots to complete said transition.

3. The transition set forth in claim 1 wherein: said second conductors comprise plated-through holes extending completely through said first and second dielectric layers with the plating metallization providing electrical connection to both said ground planes on the outwardly facing surfaces thereof.

4. The transition set forth in claim 3 wherein each of said plated-through holes passes through one of said first conductor members and is enlarged adjacent thereto so as to expose a portion of the surface thereof to which the plating metallization makes electrical connection.

5. A wide band stripline to microstrip transition providing a continuous transmission path comprising:

(1) a stripline region comprising An ungrounded central conductor of finite width disposed between an upper and a lower ground plane to support a vertical field above and a vertical field below said central conductor;

(2) a microstrip region comprising conductive extensions of said central conductor and said lower ground plane which support a vertical field below said central conductor; and (3) a transitional region having (a) a first pair of conductors connected between said ground planes and flanking said central conductor adjacent said stripline region to form a grounded closed conductive path encircling said central conductor and supporting the transfer of said vertical fields to fields radially distributed about said central conductor; and (b) a second pair of conductors flanking said central conductor and co-planar therewith and grounded to said closed conductive path to form two slots of varying width, said slots narrowing to a minimum value to transfer said radial fields to two horizontal fields supported in said double slots, and then widening to transfer said two horizontal fields to vertical fields supported in the region beneath said central conductor.

6. The transition set forth in claim 5 wherein:

said upper ground plane terminates at the narrowest point in said double slots for minimum discontinuity.

7. The transition set forth in claim 6 wherein:

said upper ground plane is supported on an upper dielectric layer over said central conductor, and said lower ground plane is supported on a lower dielectric layer under said central conductor.

8. The transition set forth in claim 7 wherein:

said first pair of conductors are formed by placing holes in said two dielectric layers and metallizing the interior thereof and adjacent portions of said upper and lower ground planes and said first pair of conductors.

9. The transition set forth in claim 8 wherein:

said second pair of conductors and said central conductor are formed on the upper surface of said lower dielectric layer.

10. The transition set forth in claim 9 wherein:

said second pair of conductors and said central conductor are formed by subtractive patterning of a common conductive layer on said upper surface.

* * * * *